US006606072B1

(12) United States Patent
Hayward et al.

(10) Patent No.: US 6,606,072 B1
(45) Date of Patent: Aug. 12, 2003

(54) ANTENNA DESIGN USING A SLOT ARCHITECTURE FOR GLOBAL POSITIONING SYSTEM (GPS) APPLICATIONS

(75) Inventors: Roger Hayward, San Francisco, CA (US); Richard Fuller, Campbell, CA (US); John Glissman, Redwood City, CA (US); Noel Marshall, Sebastopol, CA (US)

(73) Assignee: Stata Labs, LLC, Palo Alto, CA (US)

( * ) Notice: Subject to any disclaimer, the term of this patent is extended or adjusted under 35 U.S.C. 154(b) by 0 days.

(21) Appl. No.: 09/900,488

(22) Filed: Jul. 6, 2001

Related U.S. Application Data

(60) Provisional application No. 60/216,255, filed on Jul. 6, 2000.

(51) Int. Cl.[7] ..... H01Q 1/24
(52) U.S. Cl. ..... 343/767; 343/702
(58) Field of Search ..... 343/767, 702, 343/769, 718

(56) References Cited

U.S. PATENT DOCUMENTS 5,486,837 A 1/1996 Miller
5,760,745 A * 6/1998 Endo et al. ..... 343/702
5,861,854 A 1/1999 Kawahata et al.
5,929,813 A * 7/1999 Eggleston ..... 343/700 MS
6,295,030 B1 9/2001 Kozakai et al.
6,404,394 B1 6/2002 Hill
6,417,809 B1 7/2002 Kadambi et al.
6,433,743 B1 8/2002 Massey et al.
6,433,746 B2 8/2002 Kushihi et al.

* cited by examiner

*Primary Examiner*—James Clinger
(74) *Attorney, Agent, or Firm*—Townsend and Townsend and Crew LLP

(57) ABSTRACT

A GPS receiver includes a slot antenna having first and second surfaces. The second surface includes a semi-circular portion. The first and second surfaces define a slot within which is disposed dielectric material. The slot antenna is optimized for receiving GPS signals when in proximity to a human body. The relatively compact size of the slot antenna allows for the incorporation of the antenna into a small device that can be worn on or carried in close proximity to the body of a user. This type of antenna is not as sensitive to gain variations when in the proximity of a human body because the design has a wider aperture and thus operates better near the body. Further, this type of antenna is virtually omni-directional, i.e., it is not problematically sensitive to the location of the GPS signal source. Moreover, the design is such that the antenna arrangement can be oriented within a device in a way that maximizes the number of GPS satellites tracked.

37 Claims, 2 Drawing Sheets

ANTENNA DESIGN USING A SLOT ARCHITECTURE FOR GLOBAL POSITIONING SYSTEM (GPS) APPLICATIONS

CROSS-REFERENCES TO RELATED APPLICATIONS

This application claims priority to U.S. Provisional Application No. 60/216,255 entitled "An Antenna Design Utilizing A Slot Architecture For Global Positioning System (GPS) Applications," filed Jul. 6, 2000, which is incorporated herein by reference in its entirety.

STATEMENT AS TO RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

The present invention relates to antennas for receiving GPS signals. In particular, the present invention relates to GPS antennas that are optimized for use in proximity to a human body.

Navigation is key to national and international industry, commerce, and safety. Knowledge of position, both relative and absolute has been used throughout history to gain tactical advantage in both peaceful and not so peaceful pursuits. From the rudimentary techniques developed over two millennia ago, people all over the world have made both evolutionary and revolutionary progress in the business of knowing their position. Navigation progressed from simple piloting—the art of connecting known points—to satellite-based navigation systems.

Today the premier worldwide navigation solution is the Global Positioning System (GPS). This satellite-based navigation system was developed by the Department of Defense (DoD) to support a variety of military operations. This system has been used in a variety of civilian systems. As the adoption of satellite-based navigation technology has grown since its introduction in the early 1980's, so has the number and complexity of devices for personal navigation and location. GPS is broken down into three basic segments, as follows: 1) space—comprising the satellites; 2) control—incorporating tracking and command centers; and 3) user—performing navigation functions based on ranging to the satellites.

The space segment contains the GPS Space Vehicles (SVs) placed in circular orbits with 55° inclination and a semi-major axis of 26,560 km (20,182 km altitude) corresponding to an orbital period of 12 hours sidereal. There are six orbit planes placed at 60° offsets in longitude with nominally four satellites in each plane, giving 24 satellites. Currently there are 28 active satellites in the planes. Spacing within the plane is adjusted to achieve optimal coverage over regions of interest. The satellites themselves are three-axis stabilized and use solar panels to provide power. Each satellite contains a pair of atomic clocks (for redundancy) which have a stability of 1 part in $10^{13}$. Each satellite broadcasts on two frequencies, 1575.42 MHz (L1) and 1278.6 MHz (L2). The L1 signal contains two separate pseudo-random noise (PRN) modulations: 1) the Clear Acquisition (C/A) code at bit or 'chipping' rate of 1.023 MHz (i.e., each millisecond there are 1023 modulated bits or 'chips' transmitted); and 2) the so-called 'P' code which has a chipping rate of 10.23 MHz or 10 times that of the C/A code. The L2 signal only contains the P code. GPS uses a PRN coding sequence of bits that have a specified length but have the property that different codes do not strongly correlate with one another (i.e., they are orthogonal). The C/A code is 1023 chips long and thus repeats every 1 millisecond. The full P code length is 38 weeks but is truncated to 1 week.

The control segment is responsible for the operation and maintenance of the GPS. There are five monitoring stations worldwide at Kwajalein, Hawaii, Colorado Springs, Diego Garcia and Ascension. These stations measure the discrepancies between the satellite state information (satellite positions and clock) as well as health of the satellites. The Master Control Station (MCS) in Colorado Springs formulates predicted values and uploads them to the satellites. This data is then included in the new message for broadcast to the users.

The user segment comprises GPS receivers that decode the satellite messages and determine the ranges to at least four GPS SVs to determine 3-dimensional position and the receiver clock offset. Users breakdown into two main groups: authorized and unauthorized. Authorized users have full access to both the C/A and P codes. Authorized users are restricted to the military and other special groups or projects with special permission from the DoD. Unauthorized users generally cannot access the P codes as the code itself is encrypted before broadcast by a process known as anti-spoofing (AS). This makes the process of emulating a GPS signal to the authorized user more difficult. The encrypted modulated signal is known as Y code. Additionally the hand-over-word (HOW) between the C/A and Y code is also encrypted. Authorized users are given a 'key' that allows for the decryption of the HOW as well as the Y code. Authorized user receiver equipment with dual frequency code access uses what is known as the Precise Positioning Service (PPS).

GPS receivers are very sensitive devices capable of measuring the low signal levels available on, or near, the surface of the Earth. A GPS receiver design incorporates radio-frequency (RF) elements, signal downconversion, signal sampling, digital signal processing, as well as computational devices and methods. The first element of the GPS receiver that interacts with the satellite signal is the antenna. The antenna is a RF component that converts the signal present in the air to an electrical signal which is processed by the receiver.

There are many aspects that are important in antenna design that include, but are not limited to, the following: 1) frequency or frequencies of maximum sensitivity; 2) polarization; 3) size; 4) shape; 5) bandwidth; and 6) gain pattern. Depending on the goals of a particular GPS receiver, various antenna design aspects are emphasized or de-emphasized.

Given the above general background of GPS, a variety of GPS receivers have been developed to fill various market niches. One of these markets is personal GPS.

In the early 1980's, exercise began to play an increasingly important role in the daily lives of a growing segment of our society. As our economy has prospered, many of these individuals have developed into serious athletes and have helped create a thriving environment of competitive amateur athletics. These athletes represent a focused and competitive segment of our society and are devoted to their performance and to monitoring and measuring their workouts. They need systems, methods, and devices to assist in performing these tasks.

Even the most competitive and focused of athletes only have crude approximations of their performance. They typically use a stopwatch to measure the time of their activity and then estimate the average pace based on the estimated course length. This system and method only works well over a measured course, something that rarely occurs for most athletes. They can also use a heart monitor to track their exertion. Recreational athletes, who are concerned more with health and fitness than with competitive considerations, also desire quantitative feedback about their performance. However, these methods of providing performance feedback remain imprecise and unsatisfying to athletes of all types.

The idea of directly attaching a device capable of receiving and processing GPS signals to an athlete has been theorized in several quarters. By doing so, the above-discussed feedback, as well as many other performance parameters, could be virtually instantaneously provided to an athlete.

However, such a directly-attached device, if comprised solely of prior art components, would experience significant difficulty in receiving clear and processable GPS signals. Such difficulty is directly attributable to the fact that the antenna of such a device would be excessively sensitive to gain variations when in the proximity of a human body. In essence the body blocks the majority of the signal. In addition, such a prior art antenna that may incorporate patch elements or micro-strips may be excessively sensitive to the location of a GPS signal source.

The above description relates to problems and disadvantages relating to tracking, logging, and analysis of running activities. The same or similar problems and disadvantages also apply to numerous other athletic activities besides running, such as biking, skiing, and others. Furthermore, these concerns are not limited merely to athletic activities, but also apply to any GPS signal reception in close proximity to a human body, such as position determination of a user of a cellular telephone.

BRIEF SUMMARY OF THE INVENTION

In accordance with the present invention, an antenna arrangement for a GPS signal processing device having a circuit board is disclosed.

According to one embodiment, the arrangement includes a slot antenna having first and second surfaces. The second surface includes a semi-circular portion. The first and second surfaces define a slot within which is disposed dielectric material. The slot antenna is optimized for receiving GPS signals when in proximity to a human body.

The relatively compact size of the slot antenna allows for the incorporation of the antenna into a small device that can be worn on or carried in close proximity to the body of a user. This type of antenna is not as sensitive to gain variations when in the proximity of a human body because the design has a wider aperture and thus operates better near the body. Further, this type of antenna is virtually omni-directional, i.e., it is not problematically sensitive to the location of the GPS signal source. Moreover, the design is such that the antenna arrangement can be oriented within a device in a way that maximizes the number of GPS satellites tracked.

DETAILED DESCRIPTION OF THE INVENTION

For an application where the GPS receiver will be used on or near the human body, an omni-directional (or homogenous) gain pattern is of high concern. This is because satellites may be partially obstructed by the person using the receiver, decreasing the signal level received at the antenna. If the direction of the weak signal reception corresponds to a deep null of the antenna, then the signal may not be able to be tracked. Having an antenna with nearly omni-directional gain, as does the present invention, helps to avoid such a condition. If a GPS receiver is used in coordination with wireless communications device, such as a cellular phone, inadvertent signals from the device could interrupt the GPS signals. For this reason, many GPS receivers employ an electrical filter or filters to isolate the GPS signals from interference sources. Having an antenna with a very narrow bandwidth around the desired GPS frequencies, as does the present invention, reduces or eliminates the need for such filtering, which reduces the cost of components. In many cases, having small size is critical for ergonomic or other mechanical design constraints. Additionally, having flexible shape is a desirable feature for mechanical integration. In summary, the current invention represents an antenna that has the following desirable characteristics: 1) sensitivity at the GPS L1 frequency; 2) narrow bandwidth around the GPS L1 frequency; 3) small profile; 4) flexible shape; 5) omni-directional gain pattern; and 6) mountable on printed circuit board.

Figure 1:
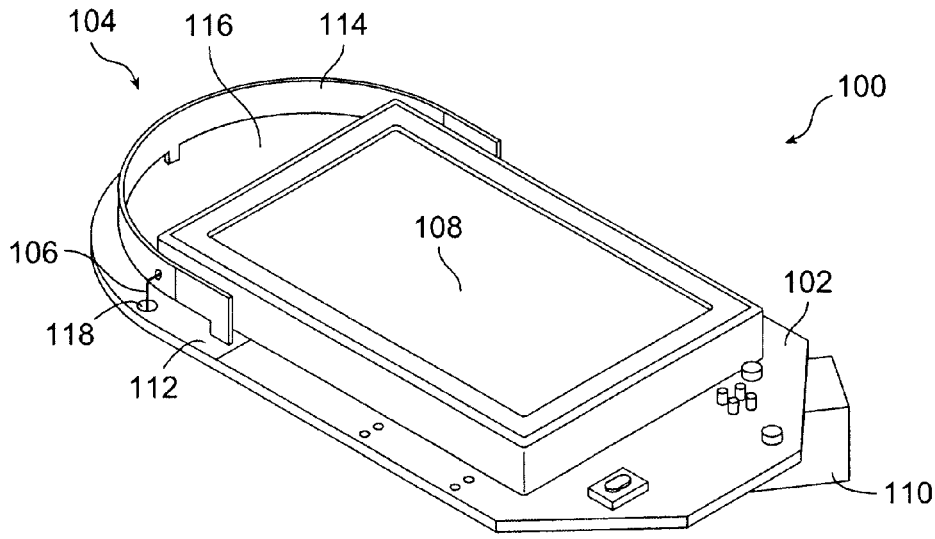
FIG. 1 is a perspective view of a GPS receiver according to one embodiment of the present invention.

FIG. 1 is an upper perspective view of a GPS receiver 100 according to one embodiment of the present invention. The GPS receiver 100 includes a circuit board 102, a slot antenna 104, a feedline 106, a display device 108, and a communication port 110. The slot antenna 104 includes a flat lower surface 112 and a curved upper surface 114. The lower surface 112 functions as a ground plane. The upper surface 114 is connected to the lower surface 112 at various points. A slot 116 is formed in the unconnected space between the lower surface 112 and the upper surface 114. Two connection points are required between the upper surface 114 and the lower surface 112 and determine the length of the slot 116. Other connection points may be added for structural or other purposes. The slot 116 may be filled with a dielectric material. The preferred dielectric material in the slot 116 is air.

Figure 2:
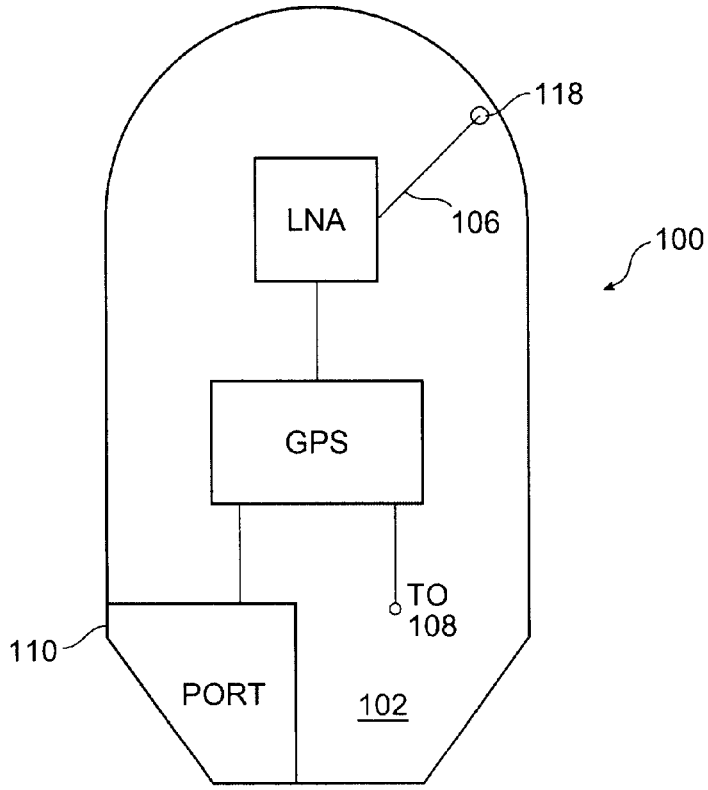
FIG. 2 is a block diagram of a portion of the GPS receiver.

The feedline 106 connects the upper surface 114 to the GPS signal processing circuitry, such as an amplifier (see FIG. 2). A hole 118 in the lower surface 112 provides access for the feedline 106. The hole 118, and thus the connection between the feedline 106 and the upper surface 114, can be located anywhere along the lower surface 112. By adjusting the location of the connection between the feedline 106 and the upper surface 114, the impedance and/or gain of the antenna 104 can be adjusted to match the input impedance and/or gain of the amplifier. Such adjustment allows for optimal functional configuration of the GPS receiver 100 in view of varying environments within which the GPS receiver 100 will be used.

The display device 108 displays GPS information or other information related to the GPS receiver 100. The communication port 110 allows the GPS signals to be routed to other components that may be associated with the GPS receiver 100, such as cellular telephone circuitry, time measurement circuitry, etc., or for the other components to route information to the GPS receiver 100.

The lower surface 112 and the upper surface 114 are composed of a conductive material such as aluminum, copper or other suitable antenna material. The conductive material of which lower surfaces 112 and upper surface 114 are composed may be identical or may vary from surface to surface.

One important design consideration of the present invention was ergonomics. A longer slot 116 enables a higher gain than a shorter slot. However, a long slot would occupy more space and diminish the ergonomic qualities of the GPS receiver 100. This consideration led to the curved shape of the upper surface 114. The curved upper surface 114 then forms a curved slot 116 that can be long yet does not occupy as much space as a straight slot. The slot 116 therefore has the benefits of a higher gain.

The lower surface 112 was also designed to be curved so it would be coincident with the upper surface 114. The display device 108 was designed to fit within the upper surface. The upper surface 114 and the display device 108 were designed to be of similar heights. In this manner the components fit together in a convenient size that may be worn or held in the hand.

The dimensions of the antenna 104 may range as follows. The slot 116 has a length of between 65 and 85 mm, nominally 75 mm, and a width (height) of between 2 and 4 mm, nominally 3 mm. These dimensions are appropriate for receiving GPS signals. The upper surface 114 has a length of between 75 and 95 mm, nominally 88 mm, and a width (height) of between 5 and 10 mm. The lower surface 112 is semi-circular with a radius of between 22 and 30 mm, nominally 25 mm. The upper surface 114 is also semi-circular with a radius less than that of the lower surface 112. The feedline 106 is located between 10% and 20%, nominally 12%, of the total length of the slot 116 from an end of the slot 116.

Another important design consideration was preventing interference due to the proximity of a user's body. With the slot antenna 104, the lower surface 112 may be disposed between the user's body and the slot 116 such that the lower surface 112 overlaps the upper surface 114 from the perspective of the user's body. The lower surface 112 then functions as a ground plane and serves to isolate the antenna 104 from the effects of the proximity of the user's body. By eliminating these effects, the antenna has attributes of omni-directionality; that is, at any orientation the antenna receives the GPS signals without interference from the user's body. This overcomes the narrow aperture defect of existing micro-strip or patch antennas. The planar resonance of the slot antenna 104 gives a wider aperture that is less susceptible to blockage due to the proximity of the user's body.

Yet another design consideration was reducing the cost and size of the GPS receiver 100. The slot antenna 104 has a narrow bandwidth of approximately 5 MHz around the GPS L1 carrier frequency. The width of the slot 116 determines the center frequency. The structure of the slot antenna gives the narrow bandwidth. Patch antennas and micro-strip antennas used in existing GPS receivers are sensitive over a much larger range of frequencies in general. Thus, having a narrow bandwidth eliminates the need for filters that would be required with existing patch or micro-strip antennas, reducing the size and cost of the GPS receiver 100.

FIG. 2 is a block diagram showing the other components of the GPS receiver 100, including an amplifier 120 and GPS signal processing circuitry 122. The amplifier 120 is coupled to the upper surface 114 of the antenna 104 by the feedline 106. The amplifier 120 is preferably a low-noise amplifier. The amplifier sets the gain of GPS signals received by the antenna 104 and carried by the feedline 106 before input to the rest of the receiver circuitry.

The GPS signal processing circuitry 122 receives the amplified GPS signals from the amplifier 120 and generates GPS data. The GPS signal processing circuitry 122 is coupled to the display device 108 for display of the GPS data. The GPS signal processing circuitry 122 is also coupled to the communications port 110 for communication of the GPS data with other components or devices. The GPS signal processing circuitry 122 may also include other features, such as time or other measurements, and may combine that information with the GPS data for display or communication with other devices. The GPS signal processing circuitry 122 may be controlled by the user to perform various functions related to the GPS data or other features, or to adjust or select the information displayed on the display device 108.

According to another embodiment, the display device 108 is located on a side of the circuit board 102 that is opposite that of the slot antenna 104. In another embodiment, the amplifier 120, processing circuitry 122 and/or communications port 110 are located on the same side of the circuit board 102 as the slot antenna 104.

The above-described embodiment is ideal for receiving and processing linearly-polarized GPS signals.

Figure 3:
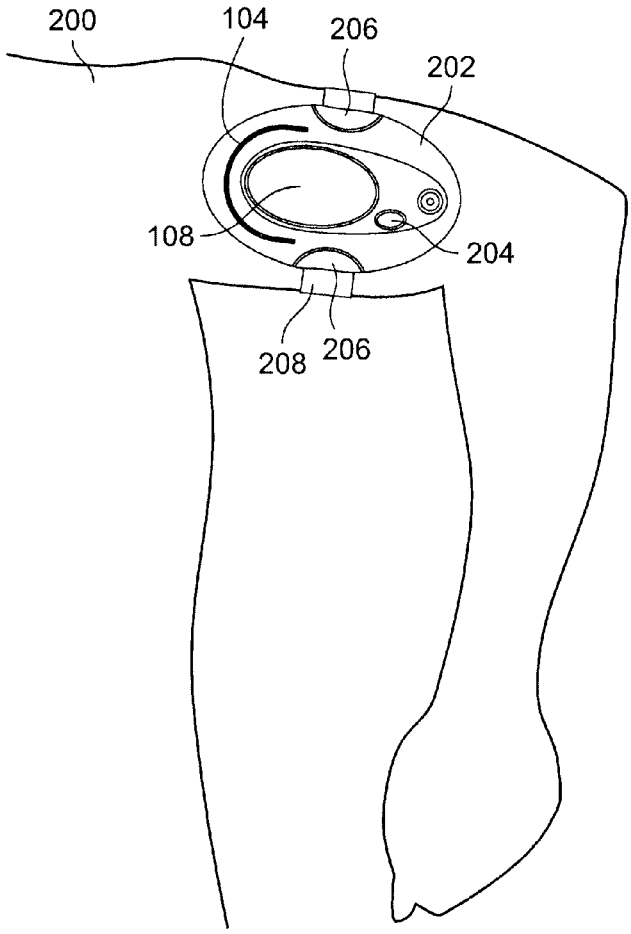
FIG. 3 is a perspective view of the GPS receiver worn by an athlete.

FIG. 3 shows in plan view an exemplary employment of the GPS receiver 100 by an athlete 200 desiring performance feedback. The GPS receiver 100 is enclosed within a housing 202. When so disposed within the housing 202, the GPS receiver 100 cooperates with controllers, such as a switch 204 and/or buttons 206 in order to supply athletic performance feedback to the athlete 200 via the display device 108. In a preferred embodiment, the housing 202 is attached to an arm of the athlete 200 by means of a strap 208 or other appropriate securing device.

Figure 4:
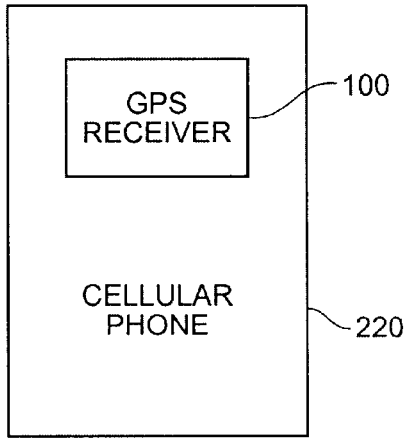
FIG. 4 is a block diagram of the GPS receiver incorporated into a cellular telephone.

FIG. 4 is a block diagram showing that the GPS receiver 100 may be incorporated into a cellular telephone 220. As described above, the problems involved in receiving GPS signals when in proximity to the user's body are also present when attempting to receive GPS signals in a hand-held device such as a cellular telephone. The GPS receiver 100 according to the present invention is also useful in these devices.

Although the invention has been described in terms of specific embodiments, it will be appreciated by those skilled in the art that various changes and modifications may be made without departing from the spirit or scope of the invention. For example, the upper surface 114 may be semi-ovular or polygonal in configuration. In addition, a plurality of apertures similar to the hole 118 can be disposed along the circuit board 102 to allow selective placement of the connection between the feedline 106 and the upper surface 114. It is intended that the scope of the invention not be limited in any way to the embodiments shown and described but that the invention be limited only by the claims appended hereto and their equivalents.

What is claimed is:

1. An apparatus including circuitry for processing global positioning system (GPS) signals, said apparatus comprising:

a slot antenna, wherein said slot antenna includes:

a first surface, and a second surface, wherein said second surface is perpendicular to said first surface, wherein said second surface includes a semi-circular portion, and wherein said first surface and said second surface define a slot having a dielectric material therein;

a feedline having one end coupled to said second surface; and an amplifier coupled to another end of said feedline and configured to amplify signals received by said slot antenna.

2. The apparatus of claim 1, further comprising:

a housing that encloses said slot antenna and orients said slot antenna such that said first surface reduces an amount of interference due to a proximity of a user of said apparatus.

3. The apparatus of claim 1, wherein said feedline is coupled to said second surface at a location such that an impedance of said amplifier is matched.

4. The apparatus of claim 3, wherein said location is, from an end of said slot, a distance of between 10% and 20% of a total length of said slot.

5. The apparatus of claim 1, wherein said second surface has a length of between 75 and 95 millimeters.

6. The apparatus of claim 1, wherein said second surface has a width of between 5 and 10 millimeters.

7. The apparatus of claim 1, wherein said first surface has a semi-circular portion.

8. The apparatus of claim 1, wherein said first surface is formed to include a hole.

9. The apparatus of claim 8, wherein said feedline passes through said hole.

10. The apparatus of claim 1, wherein said first surface overlaps and is coincident with said second surface.

11. The apparatus of claim 1, wherein said slot antenna has a narrow bandwidth.

12. The apparatus of claim 11, wherein said narrow bandwidth is 5 MHz.

13. The apparatus of claim 1, further comprising:

a processor coupled to said amplifier, wherein said processor is configured to process said signals and to generate GPS data.

14. The apparatus of claim 1, further comprising:

a cellular telephone.

15. The apparatus of claim 1, further comprising:

a printed circuit board having said slot antenna attached thereto.

16. The apparatus of claim 1, further comprising:

a display device configured to display information related to said signals, wherein said display device has a height corresponding to a height of said second surface, and wherein said second surface partially surrounds said display device.

17. The apparatus of claim 1, wherein said slot has a length of between 65 and 85 millimeters.

18. The apparatus of claim 1, wherein said slot has a width of between 5 and 10 millimeters.

19. The apparatus of claim 1, wherein one or more portions of said slot antenna divide said slot into one or more segments.

20. An apparatus including circuitry for processing global positioning system (GPS) signals, said apparatus comprising:

a slot antenna, wherein said slot antenna includes:

a first surface, and a second surface, wherein said second surface includes a semi-circular portion, and wherein said first surface and said second surface define a slot having a dielectric material therein;

a feedline having one end coupled to said second surface;

an amplifier coupled to another end of said feedline and configured to amplify signals received by said slot antenna; and a display device configured to display information related to said signals, wherein said display device has a height corresponding to a height of said second surface, and wherein said second surface partially surrounds said display device.

21. The apparatus of claim 20, further comprising:

a housing that encloses said slot antenna and orients said slot antenna such that said first surface reduces an amount of interference due to a proximity of a user of said apparatus.

22. The apparatus of claim 20, wherein said feedline is coupled to said second surface at a location such that an impedance of said amplifier is matched.

23. The apparatus of claim 22, wherein said location is, from an end of said slot, a distance of between 10% and 20% of a total length of said slot.

24. The apparatus of claim 20, wherein said second surface has a length of between 75 and 95 millimeters.

25. The apparatus of claim 20, wherein said second surface has a width of between 5 and 10 millimeters.

26. The apparatus of claim 20, wherein said first surface has a semi-circular portion.

27. The apparatus of claim 20, wherein said first surface is formed to include a hole.

28. The apparatus of claim 27, wherein said feedline passes through said hole.

29. The apparatus of claim 20, wherein said first surface overlaps and is coincident with said second surface.

30. The apparatus of claim 20, wherein said slot antenna has a narrow bandwidth.

31. The apparatus of claim 30, wherein said narrow bandwidth is 5 MHz.

32. The apparatus of claim 20, further comprising:

a processor coupled to said amplifier, wherein said processor is configured to process said signals and to generate GPS data.

33. The apparatus of claim 20, further comprising:

a cellular telephone.

34. The apparatus of claim 20, further comprising:

a printed circuit board having said slot antenna attached thereto.

35. The apparatus of claim 20, wherein said slot has a length of between 65 and 85 millimeters.

36. The apparatus of claim 20, wherein said slot has a width of between 5 and 10 millimeters.

37. The apparatus of claim 20, wherein one or more portions of said slot antenna divide said slot into one or more segments.

* * * * *